United States Patent [19]

Stark

[11] 3,963,428

[45] June 15, 1976

[54] PRINTING OF TEXTILE ARTICLES

[75] Inventor: Daniel C. Stark, La Grange, Ga.

[73] Assignee: Deering Milliken Research Corporation, Spartanburg, S.C.

[22] Filed: Jan. 3, 1974

[21] Appl. No.: 430,525

[52] U.S. Cl. ..... 8/14; 8/16; 8/62; 8/149

[51] Int. Cl.[2] ..... D06P 3/00; D06P 5/00

[58] Field of Search ..... 8/14, 16, 149, 62

[56] References Cited

UNITED STATES PATENTS

| | | | |
|---|---|---|---|
| 250,301 | 11/1881 | Toyle | 8/14 |
| 790,718 | 5/1905 | Bucher | 8/14 |
| 1,655,973 | 1/1928 | Ross | 8/14 |
| 2,107,536 | 2/1938 | James et al. | 68/211 |
| 2,321,974 | 6/1943 | Bird | 8/14 |
| 2,380,503 | 7/1945 | Croft et al. | 8/59 |
| 2,733,974 | 2/1956 | Mathewson et al. | 8/62 |
| 2,922,696 | 1/1960 | Miller | 68/211 |
| 3,220,793 | 11/1965 | Parsons et al. | 8/14 |
| 3,468,694 | 9/1969 | Moritz et al. | 8/62 |
| 3,512,914 | 5/1970 | Fleischer | 8/14 |

*Primary Examiner*—Ronald W. Griffin
*Attorney, Agent, or Firm*—H. William Petry; L. J. Wilburn, Jr.

[57] ABSTRACT

A process for printing porous textile materials, such as pile fabrics, and the resultant products, wherein the poorly defined boundaries between adjacent dissimilarly colored surface areas of the material are subsequently overprinted with a color which is retained adjacent the surface of the textile material to overlie and hide the poorly defined boundary, thus providing a more sharply defined pattern in the textile material.

12 Claims, 3 Drawing Figures

PRINTING OF TEXTILE ARTICLES

This invention relates to the printing of textile materials including fabrics, and more particularly to the dyeing and printing of relatively porous textile fabrics, particularly those having a pile surface effect, such as carpets, upholstery, towels, draperies, velvets, and the like.

In the dyeing and printing of textile fabrics to obtain various colored pattern effects, it is the practice to utilize multiple colors and to print or color adjacent areas of the fabric with these colors to produce a desired pattern. Various standard printing equipment such as screens, rollers, spray jets, and the like are employed to print the fabric and, generally, the different colored dyestuffs are sequentially applied to selected areas of the fabric surface to produce the pattern.

In the printing of textile fabrics having a relatively porous surface, such as pile fabrics, there is a problem in controlling the boundary between adjacent different colors of the pattern. Quite often, when different colors are applied to a pile fabric surface, they tend to bleed or migrate into each other at their boundaries, thus producing a poorly defined boundary and undesirable offshades at the boundary caused by a blending of the adjacent different colored dyestuffs.

Various attempts have been made in the past to improve boundary definition between adjacent different colors of patterned carpet. One such method is to simply print only the tops of the tufts of the carpets leaving the bases of the tufts uncolored, or white; however, this produces undesirable "white roots", or undyed bases, which show through to the surface of the carpet, particularly when a carpet is bent over a stair step edge, or when the pile is for some other reason displaced from its normal upright position. A second method that has been attempted is to completely dye the carpet in a light color and then to overprint the desired design without complete penetration of the overprint color; however, the "roots" of the tufts are a very light color, necessarily the lightest color appearing in the face. This results in an undesirable appearance when the carpet is bent over a stair step edge or the pile in some way displaced from its normal upright position. Total dyeing of the carpet before printing is further undesirable because the base color affects the shades of all other colors and prevents one from making clear colors of certain shades.

The present invention is directed to a method of printing textile fabrics of a porous nature to improve the definition of borders in a multi-color pattern and to alleviate the problems mentioned above. More specifically, it has been found that the undesirable visual appearance of the fabric caused by bleeding between adjacent dissimilar colors in the boundary areas of a dyed pattern on the porous fabric can be improved by overprinting the boundary line between the dissimilarly colored areas with a narrow line or stripe of dyestuff which is retained adjacent the surface of the fabric, and is of sufficient color to hide from view the previous boundary between the dissimilarly colored dyestuffs. The color of the overprinted line may be the same as the darker of the adjacent colors forming the boundary, or a different and darker color than either of the colors employed in the adjacent boundary areas of the pattern. In this manner, dyes can be employed to substantially completely pattern color pile fabrics to the depths of their pile lengths with excellent boundary definition between adjacent colors in the pattern.

Typically, in order to cover the undesirable bleeding between the two colors which have been placed in adjacent areas of a pile carpet to dye the carpet substantially to the bases of the pile tufts, the color subsequently applied to the boundary line is applied so as to be retained adjacent the surface of the pile as an overprint. The overprinted line of color may be applied so as to be retained adjacent the surface of the pile in various ways. Preferably, the viscosities of the dyes are controlled so that the adjacent pattern colors are of sufficiently low viscosity to substantially penetrate and color the pile to its base, while a relatively higher viscosity may be employed in the subsequently applied dye so as to retain it on or in the upper portion of the pile closely adjacent the pile surface. Alternatively, pressure of application and the amounts of dyes applied may be adjusted to facilitate the desired location of the dyes in the pile fabric. A combination of one or more of the above-described methods can also be employed.

As the preferred embodiment, dyes of varying viscosity are utilized in the practice of the present invention. Thus, relatively low viscosity dyestuffs can be first applied to completely color the pile to the depth of its bases, while higher viscosity colors of dyestuffs are used as the overprint, border-covering color. As mentioned, this high viscosity color is either darker than the two first applied colors or it may match the darkest of the two colors. The low viscosity colors totally penetrate the fabric. Because the high viscosity color spreads very little, the resultant effect is to produce printing that totally dyes the fabric and yet retains the crisp intricate detail of surface printing. The design is clear and sharp because it is defined by the line of non-bleeding high viscosity color.

The high viscosity color is applied as an overprint. The high viscosity color defines shapes. It may be a line or small or large areas—but it is a surface overprint used to create intricate detail or a clear, sharply defined edge or area not possible with low viscosity colors which will bleed and penetrate the entire fabric.

The invention will be better understood and further explained by reference to the accompanying drawings, in which.

Figure 1:
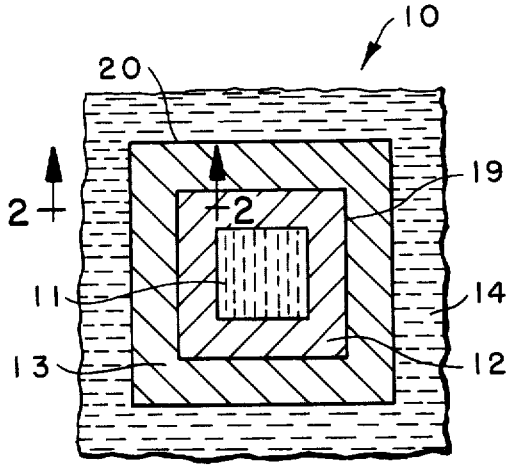
FIG. 1 is a schematic plan view of a pile fabric which has been printed with different colored dyestuffs to form a surface pattern thereon, with the adjacent colors in the pattern and the line color overprinted on the boundaries of the colors shown in contrast.

As shown in FIG. 1, a relatively porous fabric, such as a pile carpet 10, is printed in a desired pattern, such as concentric squares, by employing different colored dyestuffs in areas 11–14, with adjacent areas of color in the fabric providing boundaries therebetween.

Figure 2:
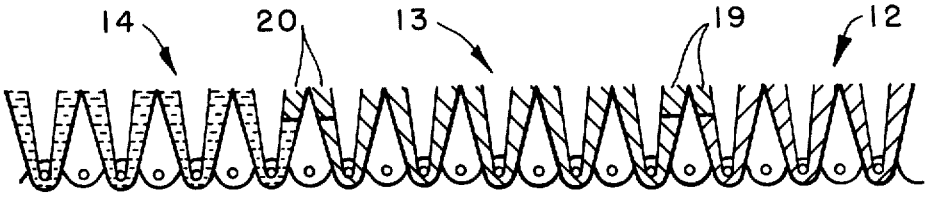
FIG. 2 is a fragmentary cross-sectional view taken along line 2—2 of the pile fabric of FIG. 1 showing the relative penetration and location of the dyestuffs employed in the invention.
Figure 3:
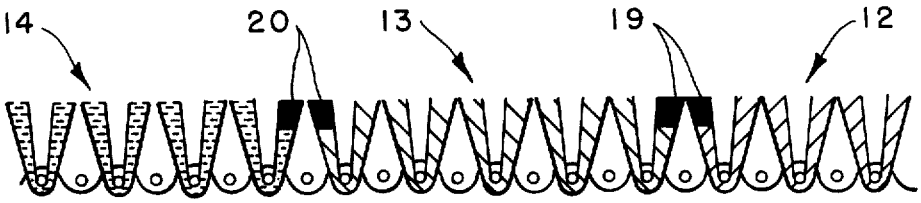
FIG. 3 is a color modification of the sectional view of the fabric of FIG. 2.

For contrast of illustration in the drawings, the colors in the areas 11–14 are shown as purple, brown, green, and grey, respectively. These dyestuffs are applied in sufficiently low viscosities, by suitable means such as screen printing, roller printing, etc. so as to penetrate to the bases of the pile fibers of the carpet, as illustrated in FIGS. 2 and 3. The boundaries between the areas are thereafter overprinted with dyestuffs of a sufficient viscosity as to be retained as a narrow line lying along the boundaries in the upper portion of the pile fibers of the carpet.

As shown in FIG. 2, the boundaries 19 and 20 between colored areas 12, 13, and 14 have been overprinted with higher viscosity green dyestuff such that the overprinted green dyestuff resides in the upper portion of the pile height to overlie and hide the underlying boundary colors.

Alternatively, as illustrated in FIG. 3, which is a color-modified view of FIG. 2, the boundaries 19 and 20 are overprinted with a black dyestuff in such a manner that the black dyestuff is retained in the upper portion of the pile fibers of the carpet. In this manner, the overprinted lines of dyestuffs overlie and hide the poorly defined visual boundary of the previously applied dyestuffs.

The porous fabrics of the present invention may be printed in any suitable manner. The adjacent colors forming the initial boundary lines in the pattern of the fabric are applied (either simultaneously or sequentially) prior to the application of the overlying boundary line color. The invention is deemed applicable to any type of relatively porous fabric material wherein bleeding or wicking of adjacent dissimilar colors occurs, and wherein a subsequent dyestuff may be applied on the boundary line at a controlled viscosity so as to be generally contained above the previously applied dyestuffs in the upper surface areas of the fabric. As mentioned, a dissimilar darker colored dyestuff may be used to provide an aesthetic boundary line effect in the pattern, or the boundary line color may be the same color as the darker of the underlying adjacent colors to provide a highly defined, sharp boundary between the colors.

The particular viscosities of dyestuffs employed in depend printing of the carpets will, of course, epend upon the type and density of fiber employed in the carpet pile, as well as the particular method of application of the dyestuff to the carpet.

Typically, the invention may be further illustrated by the following specific example. A tufted cut pile filament nylon white carpet having a ¾ inch pile height is prepared by tufting a base fabric with three-ply, 1200 denier autoclave heat set DuPont nylon. The pile yarn weight is 30 ounces per square yard. The undyed carpet is printed on a flat bed Zimmer screen printer with the following colors applied sequentially from 74 mesh screens to adjacent surface areas of the carpet to provide a printed pattern effect:

| Screen No. | Color | Viscosity, in cps. |
|---|---|---|
| 1 | Light Red | 150–300 |
| 2 | Medium Red | 150–300 |
| 3 | Bronze Gold | 150–300 |
| 4 | Dark Red | 150–300 |
| 5 | Wine Red | 150–300 |
| 6 | Black | Approx. 2,000 |

As in standard practice, each screen is provided with a portion of the desired overall pattern to be printed. The viscosities of the liquid dyes are suitably controlled within the above specified ranges by addition of a conventional thickener, such as a guar bean or locust bean composition. The first five colors totally print the carpet with complete penetration of the dyestuffs to the base of the fibers, but the image remains blurry and the areas of each color are not clearly defined as to boundary. The sixth color is a narrow line of black which does not penetrate the carpet fully, but does overlie the borders between areas and define each colored area of the pattern. The black also covers the blur of the bleeding color of the boundary edges and is an overprint of the already totally printed carpet. The effect is clear, sharp printing of a thick, heavy carpet utilizing an unrestricted choice of colors.

From the foregoing description of the invention there has been disclosed a unique process for the printing of porous textile materials, and the provision of novel printed textile products produced thereby.

That which is claimed is:

1. A process for printing a textile material having a relatively porous surface comprising the steps of applying to adjacent surface areas of the material dissimilarly colored liquid dyestuffs so as to produce a boundary line therebetween, and subsequently applying to the boundary line a narrow line of dyestuffs so as to be retained in the upper portion of the porous material adjacent the surface in overlying relation to the boundary line to effectively hide the same from view.

2. A process as defined in claim 1 wherein the subsequently applied dyestuff is of higher viscosity than the previously applied dissimilarly colored dyestuffs.

3. A process as defined in claim 1 wherein the subsequently applied dyestuff is of a different color from the dyestuffs applied in the adjacent areas of the textile material.

4. A process as defined in claim 1 wherein the subsequently applied dyestuff is of the same color as the darker of the dissimilarly colored dyestuffs previously applied in adjacent surface areas of the material.

5. A process as defined in claim 1 wherein the dyestuffs are applied to a textile pile fabric.

6. A process as defined in claim 5 wherein the dyestuffs are applied to a pile carpet.

7. A process for printing a textile pile material comprising the steps of preparing a plurality of dyestuffs of dissimilar color, applying the dissimilar dyestuffs to adjacent surface areas of the pile material to penetrate the pile material sufficiently throughout the height of the pile while forming a color boundary between adjacent dissimilarly colored areas of the pile material, and subsequently applying to the color boundary a narrow line of dyestuff so as to be retained in the upper portion of the pile material adjacent the surface thereof to effectively hide the previously formed color boundary from view.

8. A process as defined in claim 7 wherein the first applied dissimilar dyestuffs are provided with a lower viscosity to facilitate penetration of the depth of the pile of the material and the subsequently applied dyestuff is provided with a higher viscosity to facilitate location of the dyestuff in the upper surface areas of the pile of the material.

9. A textile material having a relatively porous printed surface comprising adjacent areas of dissimilar colors defining a boundary line therebetween, and a narrow line of color overlying the boundary line to hide the same effectively from view.

10. A product as claimed in claim 9 wherein the textile material is a pile fabric.

11. A pile fabric as defined in claim 10 wherein the color overlying the boundary line is of the same color as the darker of the colors in the adjacent areas thereto.

12. A pile fabric as defined in claim 10 wherein the color overlying the boundary line is of a different and darker color than the dissimilar colors in the adjacent areas thereto.

* * * * *

UNITED STATES PATENT OFFICE

CERTIFICATE OF CORRECTION

Patent No. 3,963,428 Dated June 15, 1976

Inventor(s) Daniel C. Stark

It is certified that error appears in the above-identified patent and that said Letters Patent are hereby corrected as shown below:

Column 3, line 39, the first word "depend" should read --the--.
Column 3, line 39, the last word "epend" should read --depend--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*